US005639589A

United States Patent [19]

Bauer et al.

[11] Patent Number: 5,639,589

[45] Date of Patent: Jun. 17, 1997

[54] PHOTOGRAPHIC ELEMENT AND POLYESTER PHOTOGRAPHIC FILM BASE THEREFOR

[75] Inventors: Charles Leo Bauer, Webster; Janglin Chen, Rochester; David Appler Glocker, West Henrietta; Melinda Gay Messick, Rochester, all of N.Y.

[73] Assignee: Eastman Kodak Company, Rochester, N.Y.

[21] Appl. No.: 644,022

[22] Filed: May 9, 1996

Related U.S. Application Data

[63] Continuation-in-part of Ser. No. 390,258, Feb. 17, 1995, abandoned.

[51] Int. Cl.[6] ..... G03C 1/76

[52] U.S. Cl. ..... 430/532; 430/531; 430/533; 430/534

[58] Field of Search ..... 430/531, 532, 430/533, 539

[56] References Cited

U.S. PATENT DOCUMENTS

| | | | |
|---|---|---|---|
| 3,341,505 | 9/1967 | Gander | 526/287 |
| 3,400,103 | 9/1968 | Samour et al. | 427/208.4 |
| 4,252,885 | 2/1981 | McGrail et al. | 430/532 |
| 4,304,851 | 12/1981 | McGrail et al. | 430/533 |
| 4,689,359 | 8/1987 | Ponticello et al. | 524/23 |
| 4,695,532 | 9/1987 | Ponticello et al. | 430/533 |
| 5,326,689 | 7/1994 | Murayama | 430/532 |

*Primary Examiner*—Hoa Van Le

*Attorney, Agent, or Firm*—Joshua G. Levitt; Carl F. Ruoff

[57] ABSTRACT

A polyester photographic film support having a surface coated with a subbing layer which comprises a mixture of gelatin and a polymer where the gelatin to polymer ratio is less than 97:3 and such that the combination of dry coverage and weight fraction of gelatin in the mixture satisfies the equation: $C+1.32\times Z\geqq 0.825$, where C is dry coverage in $g/m^2$ and Z is the weight fraction of gelatin, and the polymer comprises:

a) from 1 to 60 weight percent of recurring units derived from a vinyl monomer having a primary amine addition salt component or aminostyrene addition salt component;

b) from 0 to 50 weight percent of recurring units derived from a hydrophilic vinyl monomer; and c) from 20 to 98 weight percent of recurring units derived from a hydrophobic nonionic vinyl monomer.

23 Claims, No Drawings

PHOTOGRAPHIC ELEMENT AND POLYESTER PHOTOGRAPHIC FILM BASE THEREFOR

This application is a continuation-in-part of our prior, U.S. patent application Ser. No. 08/390,258, filed Feb. 17, 1995, now abandoned.

FIELD OF THE INVENTION

This invention relates to polyester photographic film base and to photographic elements having a light-sensitive photographic layer on the film base. In particular, the invention relates to a subbing layer for improving the adhesion of subsequently applied layers to polyester film base.

DESCRIPTION OF RELATED ART

It is difficult to adhere photographic emulsions to oriented polyester supports, such as polyethylene terephthalate or polyethylene naphthalate. The subbing system must work both with unprocessed and processed film in the dry state, and must also adhere when the film is wet during the development process.

U.S. Pat. Nos. 4,695,532 and 4,689,359 describe a discharge treated polyester film support having coated directly thereon a subbing layer comprising a mixture of gelatin and an aqueous vinyl acrylate copolymer having a ratio of gelatin to polymer of between 5:95 to 40:60 and a dry coverage of between 0.11 and 0.55 g/m$^2$. Although this subbing system has good adhesion before processing, it has been found that adhesion after contact with photographic developing solutions is severely degraded.

It is desirable to provide a subbing system that provides both good wet and dry adhesion of photographic elements to discharge treated polyester supports both before and after photographic processing.

We have found that adhesion of photographic emulsions to polyester supports can be improved by modifying the subbing systems of U.S. Pat. Nos. 4,695,532 and 4,689,359 to increase the content of gelatin.

SUMMARY OF THE INVENTION

Thus, in accordance with this invention, there is provided a polyester photographic film support having a surface bearing a subbing layer which comprises a mixture of gelatin and a polymer wherein:

a) the gelatin to polymer ratio is less than 97:3;

b) the combination of dry coverage and weight fraction of gelatin in the mixture satisfies the equation: $C+1.32\times Z\geqq 0.825$, where C is dry coverage in g/m$^2$ and Z is the weight fraction of gelatin; and c) the polymer comprises:

a) from 1 to 60 weight percent of recurring units derived from a vinyl monomer having a primary amine addition salt component or an aminostyrene addition salt component;

b) from 0 to 50 weight percent of recurring units derived from a hydrophilic vinyl monomer; and c) from 20 to 98 weight percent of recurring units derived from a hydrophobic vinyl monomer.

By operating within these parameters, superior processed dry adhesion is obtained even with a thinner subbing layer and higher ratios of gelatin to polymer.

DESCRIPTION OF PREFERRED EMBODIMENTS

The invention contemplates the use of a gelatin/polymer mixture with concentrations of polymer greater than 3%, such that the combination of dry coverage (C, in units of g/m2) and weight fraction of gelatin (Z) in the mixture satisfies the equation: $C+1.32\times Z\geqq 0.825$. This equation describes a combination of subbing coverage and gelatin/polymer ratio that provides peel force values greater than or equal to 309 N/m. In a preferred embodiment, the mixture satisfies the equation $C+1.44\times Z\geqq 0.9$. This preferred equation describes a combination of subbing coverage and gelatin/polymer ratio that provides peel force values greater than or equal to 370 N/m.

Preferred gelatin/polymer ratios are in the range of from 80:20 to 65:35 and preferred dry coverages are greater than 0.09 g/m$^2$, preferably a coverage of between 0.11 g/m$^2$ and 0.40 g/m$^2$. We have found, in general, that at absolute low levels of gelatin the photographic emulsion does not adequately adhere to the support after processing and that as the absolute level of gelatin increases the dry adhesion significantly improves, until at very high levels of gelatin (about 90% dry coverage) the wet adhesion deteriorates.

As used throughout this specification, the coverage of the subbing layer is expressed in terms of dry coverage of the polymer and gelatin components. Those skilled in the art will recognize that dry coverage is easily calculated from the rate and amount of coating solution that is applied to form the subbing layer. This provides a wet laydown of the solution; and by knowing the solution density and percent solids, the dry coverage can be calculated. If one does not know the details of the coating solution which was used to form an existing subbing layer, dry coverage can be measured by techniques well known to those skilled in the art, such as variable angle spectroscopic ellipsometry. This technique is described in Hilfiker et al., Automated Spectroscopic Ellipsometry, pp. 30–34, *The Industrial Physicists*, March 1996, and in Woollam et al. Fundamentals and Applications of Variable Angle Spectroscopic Ellipsometry, pp. 279–283, Materials Science and Engineering, B5(1990). The disclosures of these articles and the references cited in them are incorporated herein by reference.

The polymers used in this invention are the same as those described in the above-mentioned U.S. Pat. Nos. 4,689,359 and 4,695,532, the disclosures of which are incorporated herein by reference. They comprise:

(a) from 1 to 60 weight percent of recurring units derived from vinyl monomer having a primary amine addition salt component or an aminostyrene addition salt component;

(b) from 0 to 50 weight percent of recurring units derived from a nonionic hydrophilic vinyl monomer; and (c) from 20 to 98 weight percent of recurring units derived from a hydrophobic nonionic vinyl monomer. The disclosed subbing layers are particularly useful as coating compositions for polyester supports.

In these polymers, less than 1 weight percent of component (a) causes the polymer to lose water stability. More than 60 weight percent of component (a) causes the polymer to be too hydrophilic and lose wet adhesion. Component (c) is added to assist in adjusting the balance of hydrophilic and hydrophobic properties of the polymer.

Preferably, the polymers of this invention comprise a polymerized vinyl monomer containing a primary amine addition salt component which has the structure:

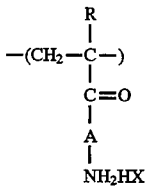

and/or a polymerized vinyl monomer containing an aminostyrene component which has the structure:

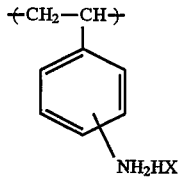

wherein

R is hydrogen or methyl;

A is either —$OR^1$— or

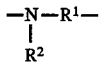

$R^1$ is a straight or branched chain alkylene group of 1 to 6 carbon atoms;

$R^2$ is hydrogen or a straight or branched chain alkyl or cycloalkyl group of 1 to 10 carbon atoms; and X is an acid anion.

The polymers of this invention may be prepared by latex polymerization, or solution polymerization followed by dispersion of the polymer in water by addition of the organic solution to water containing a surfactant. Polymers prepared in both ways are effective in improving adhesion between polyester supports and subsequently coated gelatin layers including gelatin containing silver halide layers. Both latex polymerization and solution polymerization are well known. See W. R. Sorenson and T. N. Campbell, "Preparative Methods of Polymer Chemistry", 2nd Ed., J. Wiley and Sons, New York, N.Y. (1968) and M. R. Stevens, "Polymer Chemistry, an Introduction", Addison-Wesley Publishing Co., Inc., London (1975).

In latex polymerization the selected monomers are colloidally emulsified in an aqueous medium that usually contains a cationic, nonionic, or zwitterionic surfactant and a polymerization catalyst such as 2,2'-azobis(2-amidinopropane)hydrochloride. The resulting colloidal emulsion is then subjected to conditions conducive to polymerization of the monomeric constituents to produce an aqueous colloidal dispersion commonly called a latex.

Solution polymerization generally involves dissolving the selected monomers in an organic solvent containing a polymerization initiator such as 4,4'-azobis(4-cyanovaleric acid), 2,2'-azobis(2-methylpropionitrile) and 2,2'-azobis(2-amidinopropane)hydrochloride. The solution is maintained under a nitrogen atmosphere and heated at about 60° C. The resulting polymer is then dispersed in water at about 1–5 percent solids. The polymer is then purified by diafiltration.

Useful starting monomers having a primary amine addition salt component include 2-aminoethyl methacrylate hydrochloride, N-(3-aminopropyl) methacrylamide hydrochloride, and p-aminostyrene hydrochloride. Addition salts of other acids can also be used, e.g., hydrobromic, phosphoric, sulfuric, and benzoic acids.

Useful hydrophilic nonionic vinyl monomers include 1-vinylimidazole, 2-methyl-1-vinylimidazole, 2-hydroxyethyl acrylate, 2-hydroxyethyl methacrylate, acrylamide and 2-acetoxyethyl methacrylate.

Useful hydrophobic vinyl monomers include alkyl acrylates such as butyl acrylate, N-butyl methacrylate, ethyl methacrylate, styrene, and the like.

Especially preferred polymers for use in the subbing layers of this invention include polymers comprising (a) from 1 to 60 weight percent of recurring units derived from 2-aminoethyl methacrylate hydrochloride;

(b) from 1 to 50 weight percent of recurring units derived from hydroxyethyl methacrylate; and (c) from 20 to 98 weight percent of recurring units derived from butyl acrylate.

Suitable polyester film supports are highly polymeric linear polyesters of bifunctional aromatic dicarboxylic acids and bifunctional polyhydroxy organic compounds. Generally, they are polyesters derived from terephthalic dicarboxylic acids or naphthalene dicarboxylic acids and alkylene diols. These are well known and can be prepared from any of the polyester compositions described, for example, in Nadeau U.S. Pat. No. 2,943,937 or in Alles et al., U.S. Pat. No. 2,627,088. Especially useful polyester film support is that formed from poly(ethylene terephthalate) or poly(ethylene naphthalate).

The support may be treated with corona discharge (CDT), UV, glow discharge (GDT), flame or other such methods that alter the support surface. The preferred method is the glow discharge treatment as described in U.S. Pat. No. 5,425,980, incorporated herein by reference.

Glow discharge is a well-known method of promoting adhesion in a wide variety of systems. For example, U.S. Pat. No. 3,288,638 describes the GDT treatment of polymers in an inert gas environment to promote adhesion of metals. The desirable results of adhesion are attributed to the bombardment of the surfaces by inert gas ions and electrons.

U.S. Pat. No. 3,837,886 describes the use of GDT to promote the adhesion of a gelatin containing binder to biaxially drawn, surface roughened polystyrene. Tatsuta and Ueno, the inventors of U.S. Pat. No. 3,837,886, find that GDT is ineffective without first roughening the polystyrene surface. They also report that the choice of treatment gas is unimportant.

Dolezalek et al U.S. Pat. No. 4,451,497 discusses the treatment of various polyester supports to promote the adhesion of photographic emulsions directly onto the support. They attribute the beneficial effects to a reduction in surface charge and report no particular dependence on the gas used in the treatment.

Ishigaki and Naoi (U.S. Pat. No. 4,933,267) report using GDT in connection with improving the dimensional stability of photographic systems, but mention no reason to choose a particular treatment gas. The implication is that the treatment is done in residual air. In a subsequent patent (U.S. Pat. No. 4,954,430), they describe the use of GDT prior to coating with a copolymer containing vinylidine chloride and again fail to mention any advantage to the use of a particular treatment gas.

Stroebel (European Application 92303556.2) teaches that nitrogen CDT can be effective, carried out at atmospheric pressure, if the temperature of the support is elevated during treatment. There is no evidence that GDT in nitrogen at ambient temperatures would be effective. Thus, the prior art does not teach what surface conditions are required on a polyester substrate for promoting adhesion of photosensitive coating compositions.

Finally, in U.S. Pat. No. 5,324,414, an Ion Selective Electrode and Method of Manufacture is described. The method uses glow discharge to deposit metallic silver on a polymeric surface. This application also does not teach what surface conditions are required for promoting adhesion of photosensitive coatings to polyester substrates. The preferred method of treatment provides surface chemistry to the support that is beneficial for adhesion of the subbing. The treatment conditions for obtaining a proper support using GDT, are specified. The specification includes the type of gas in which the treatment takes place, the pressure and the energy density.

The present invention includes a polyester film support whose surface is modified by energetic treatment. The uppermost 5 nm of the support includes nitrogen from about 7 atomic percent to about 15 atomic percent wherein the nitrogen is in the form of imines, secondary amines, and primary amines in the ratio of about 1:1:2. The film support of the present invention preferably is polyethylene naphthalate (PEN) or polyethylene terephthalate (PET).

The present invention also includes a support which is made from a polyester substrate wherein the uppermost 5 nm includes oxygen in the form of hydroxyl, ether, epoxy, carbonyl or carboxyl groups wherein the oxygen is from about 4 atomic percent to about 10 atomic percent above the oxygen content (22% for PEN and 28.6% for PET). The polyester preferably is polyethylene naphthalate or polyethylene terephthalate.

The gelatin in the subbing layer in accordance with this invention includes any type of gelatin such as acid processed gelatin or lime processed gelatin. Acid processed, deionized gelatin is preferred for use in the subbing layers of this invention. A hardening agent such as chrome alum and matte particles such as poly(methyl methacrylate) beads may be used if desired. To improve coatability, a surfactant, such as Olin 10G, Saponin or Alkanol-XC, may be used.

The invention will be further illustrated by the following examples:

EXAMPLE 1

Photographic elements are prepared by coating the following layers in order on a 4 mil oriented and annealed polyethylene naphthalate support that has been nitrogen glow discharge treated (70 mT, 0.75 kW, 50 fpm for a 13 inch wide PEN support).

Layer 1) A gelatin/poly(n-butyl acrylate-co-2-aminoethyl methacrylate hydrochloride-co-2-hydroxyethyl methacrylate (50/5/45), (hereinafter referred to as polymer P-1), subbing layer with 2 wt % chrome alum and 0.1% (by wt of total solution mass) Saponin as surfactant are coated from water. Variations in gelatin/polymer ratios are described in Table 1. The coating solutions are applied using a coating hopper and dried for a time sufficient to remove water.

The following layers in the given sequence are applied to the supports as described above. The quantities of silver halide are given in grams of silver per $m^2$. The quantities of other materials are given in g per $m^2$.

Layer 2 {Antihalation Layer} black colloidal silver sol containing 0.236 g of silver, with 2.44 g gelatin.

Layer 3 {First (least) Red-Sensitive Layer} Red sensitized silver iodobromide emulsion [1.3 mol % iodide, average grain diameter 0.55 microns, average thickness 0.08 microns] at 0.49 g, red sensitized silver iodobromide emulsion [4 mol % iodide, average grain diameter 1.0 microns, average thickness 0.09 microns] at 0.48 g, cyan dye-forming image coupler C-1 at 0.56 g, cyan dye-forming masking coupler CM-1 at 0.033 g, BAR compound B-1 at 0.039 g, with gelatin at 1.83 g.

Layer 4 {Second (more) Red-Sensitive Layer} Red sensitive silver iodobromide emulsion [4 mol % iodide, average grain diameter 1.3 microns, average grain thickness 0.12 microns] at 0.72 g, cyan dye-forming image coupler C-1 at 0.23 g, cyan dye-forming masking coupler CM-1 at 0.022 g, DIR compound D-1 at 0.011 g, with gelatin at 1.66 g.

Layer 5 {Third (most) Red-Sensitive Layer} Red sensitized silver iodobromide emulsion [4 mol % iodide, average grain diameter 2.6 microns, average grain thickness 0.13 microns] at 1.11 g, cyan dye-forming image coupler C-1 at 0.13 g, cyan dye-forming masking coupler CM-1 at 0.033 g, DIR compound D-1 at 0.024 g, DIR compound D-2 at 0.050 g, with gelatin at 1.36 g.

Layer 6 {Interlayer} Yellow dye material YD-1 at 0.11 g and 1.33 g of gelatin

Layer 7 {First (least) Green-Sensitive Layer} Green sensitized silver iodobromide emulsion [1.3 mol % iodide, average grain diameter 0.55 microns, average grain thickness 0.08 microns] at 0.62 g, green sensitized silver iodobromide emulsion [4 mol % iodide, average grain diameter 1.0 microns, average grain thickness 0.09 microns] at 0.32 g, magenta dye-forming image coupler M-1 at 0.24 g, magenta dye-forming masking coupler MM-1 at 0.067 g with gelatin at 1.78 g.

Layer 8 {(Second (more) Green-Sensitive Layer} Green sensitized silver iodobromide emulsion [4 mol % iodide, average grain diameter 1.25 microns, average grain thickness 0.12 microns] at 1.00 g, magenta dye-forming image coupler M-1 at 0.091 g, magenta dye-forming masking coupler MM-1 at 0.067 g, DIR compound D-1 at 0.024 g with gelatin at 1.48 g.

Layer 9 {Third (most) Green-Sensitive Layer} Green sensitized silver iodobromide emulsion [4 mol % iodide, average grain diameter 2.16 microns, average grain thickness 0.12 microns] at 1.00 g, magenta dye-forming image coupler M-1 at 0.0.72 g, magenta dye-forming masking coupler MM-1 at 0.056 g, DIR compound D-3 at 0.01 g, DIR compound D-4 at 0.011 g, with gelatin at 1.33 g.

Layer 10 {Interlayer} Yellow dye material YD-2 at 0.11 g with 1.33 g gelatin.

Layer 11 {First (less) Blue-Sensitive Layer} Blue sensitized silver iodobromide emulsion [1.3 mol % iodide, average grain diameter 0.55, average grain thickness 0.08 microns] at 0.24 g, blue sensitized silver iodobromide emulsion [6 mol % iodide, average grain diameter 1.0 microns, average grain thickness 0.26 microns] at 0.61 g, yellow dye-forming image coupler Y-1 at 0.29 g, yellow dye forming image coupler Y-2 at 0.72 g, cyan dye-forming image coupler C-1 at 0.017 g, DIR compound D-5 at 0.067 g, BAR compound B-1 at 0.003 g with gelatin at 2.6 g.

Layer 12 {Second (more) Blue-Sensitive Layer} Blue sensitized silver iodobromide emulsion [4 mol % iodide, average grain diameter 3.0 microns, average grain thickness 0.14 microns] at 0.23 g, blue sensitized silver iodobromide emulsion [9 mol % iodide, average grain diameter 1.0 microns] at 0.59 g, yellow dye-forming image coupler Y-1 at 0.090 g, yellow dye-forming image coupler Y-2 at 0.23 g, cyan dye-forming image coupler C-1 0.022 g, DIR compound D-5 at 0.05 g, BAR compound B-1 at 0.006 g with gelatin at 1.97 g.

Layer 13 {Protective Layer} 0.111 g of dye UV-1, 0.111 g of dye UV-2, unsensitized silver bromide Lippman emulsion at 0.222 g, 2.03 g.

This film is hardened at coating with 2% by weight to total gelatin of hardener H-1. Surfactants, coating aids, scavengers, soluble absorber dyes and stabilizers are added to the various layers of this sample as is commonly practiced in the art.

The structural formulae for the components identified above by letter abbreviation are as follows:

C-1:

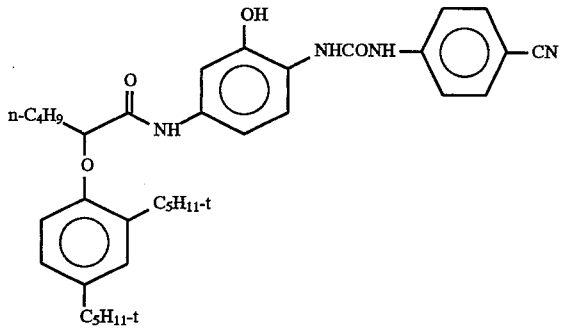

CM-1

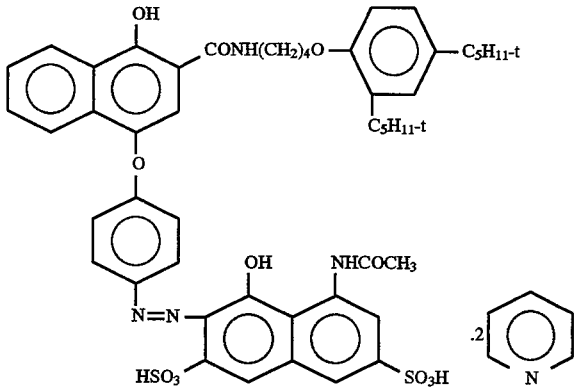

B-1

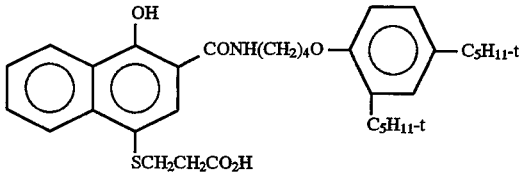

D-1:

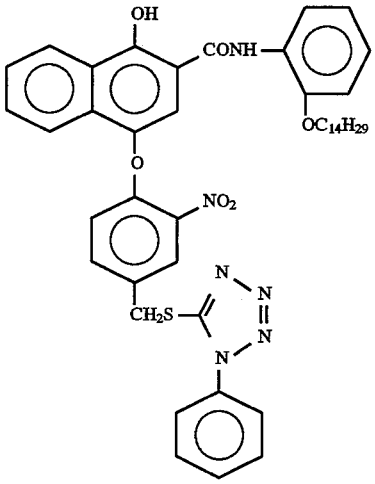

-continued
D-2
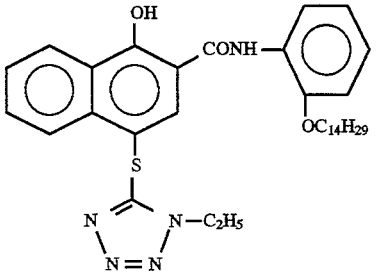
D-3:
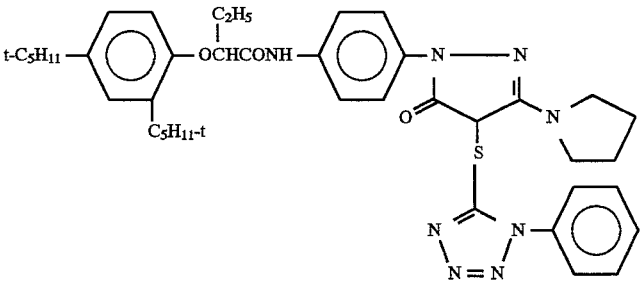
D-4
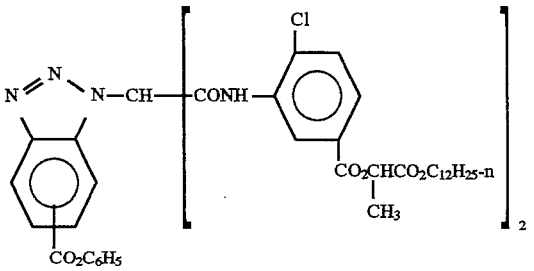
D-5:
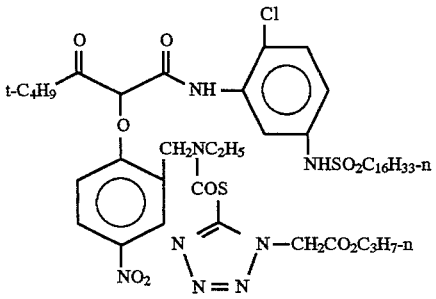
MM-1
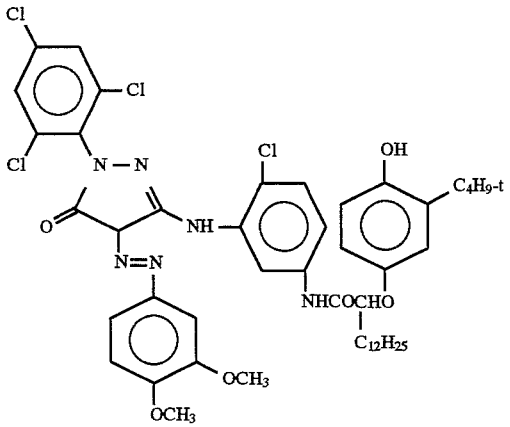

-continued
Y-1:
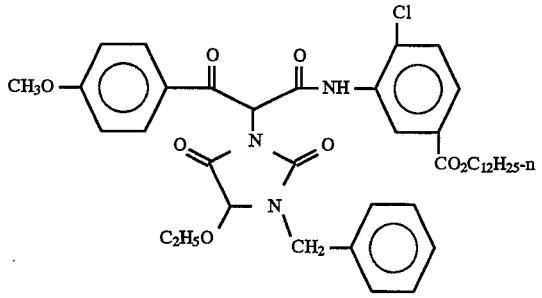
Y-2:
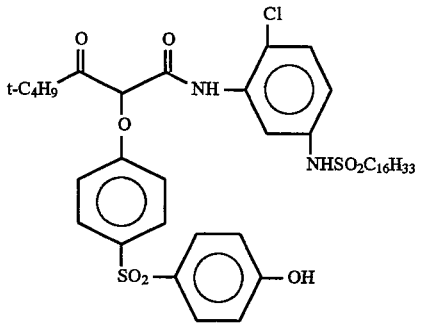
M-1:
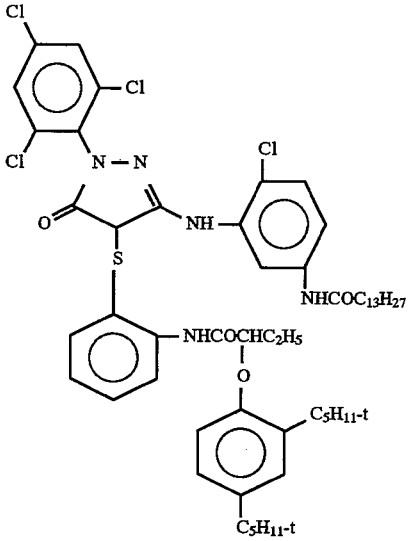
YD-1:
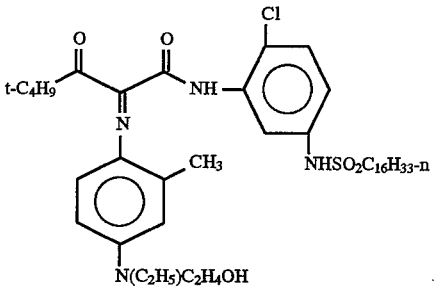
YD-2:
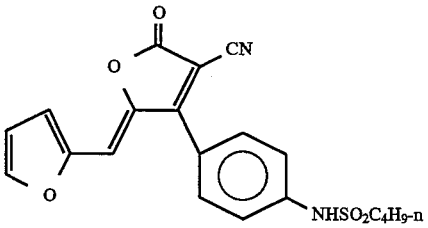

-continued

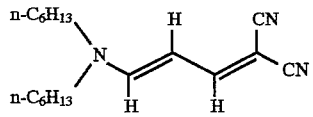

UV-1:

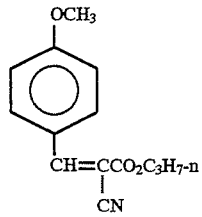

UV-2:

$CH_2(SO_2CH{=}CH_2)_2$

H-1:

The surface of the support opposite that bearing the subbing layer can contain magnetic recording layers, antistatic layers, subbing layers, lubrication layers, and the like, as described in U.S. Pat. No. 5,514,528, the disclosure of which is incorporated herein by reference.

As comparisons, there are coated a gelatin subbing layer (0.132 g/m$^2$), and a subbing layer comprised of gelatin/poly (n-butylacrylate-co-2-aminoethyl methacrylate hydrochloride-co-2-hydroxyethyl methacrylate) (50/5/45 wt ratio) (15/85 sub) (0.385 g/m$^2$).

Incubated samples (24 hours, 32.2° C./50% RH) are evaluated for both wet and dry as described immediately below and the results are shown in Table 1, below. The adhesion tests to which the samples are submitted have been shown to directly correlate with the actual performance of photographic materials as they are handled under actual conditions. These tests simulate situations to which a photographic material might be exposed under actual conditions which would disrupt the bond between the subbing layer and the adjacent emulsion layer. The Dry Adhesion Test simulates, in a controlled fashion, the removal of splicing tape from a film strip after processing. Splicing tape is commonly used to join separate strips of film to a leader card or to one anothers so as to permit their continuous transport through processing apparatus. The Wet Adhesion Test measures the amount of emulsion which would be removed in a developer solution when a film strip is subjected to a uniform cyclic load. In this test, the scribing of the film with a metal stylus simulates a scratch on the emulsion which could be formed by any one of a number of sources prior to processing. The load applied to the surface simulates a stuck idler roll or squeege which the emulsion side of the film might contact as it moves through processing apparatus.

Dry Adhesion Test 35 mm strips of coated samples are first processed using a C41 developing process. Then a sample approximately 1.9 cm wide and 15 cm long is prepared and a score line is cut across the sample through the emulsion coating near the top of the strip, about 2 cm from the top. A piece of 3M 471 ¾"Pressure Sensitive Vinyl Yellow Tape is applied onto the sample and excess sample is trimmed away from the tape with a sharp blade. The tape is slowly pulled back from the top to the score mark, trying to force the emulsion to peel off with the tape. The sample is placed in an Instron tensile testing machine and the amount of force required to remove the tape/emulsion at a rate of 100 cm/min. is recorded. Peel force values are reported in units of N/m with higher numbers indicating a stronger adhesive bond. If the emulsion could not be peeled off with this tape a "Did not peel" or DNP is reported.

Wet Adhesion Test

A 35 mm×12.7 cm strip of the coating is soaked at 37.8° C. for 3 min. 15 sec. in Kodak Flexicolor Developer Replenisher. The strip is then scored with a pointed stylus tip across the width of the strip and placed in a small trough filled with a developer solution. A weighted (900 g) filled natural rubber pad, 3.49 cm diameter, is placed on top. The pad is moved back and forth across the strip 100 times. The amount of emulsion removal is then assessed given in units of % removed. The lower the value the better the wet adhesion of the system.

TABLE 1

| Sample | Subbing | Wt. Ratio (gel/P-1) | Dry Coverage (g/m2) | Wet Adhesion (% removed) | Dry Adhesion (N/m) |
|---|---|---|---|---|---|
| Comparison | Gelatin | — | 0.132 | 100 | DNP |
| Comparison | Gel/P-1 | 97/3 | 0.132 | 75 | DNP |
| Invention | Gel/P-1 | 90/10 | 0.132 | 29 | DNP |
| Invention | Gel/P-1 | 90/10 | 0.385 | 34 | DNP |
| Invention | Gel/P-1 | 85/15 | 0.132 | 0 | DNP |
| Invention | Gel/P-1 | 80/20 | 0.132 | 0 | DNP |
| Invention | Gel/P-1 | 68/32 | 0.132 | 0 | DNP |
| Invention | Gel/P-1 | 68/32 | 0.385 | 1 | DNP |
| Invention | Gel/P-1 | 75/25 | 0.132 | 0 | DNP |
| Invention | Gel/P-1 | 75/25 | 0.264 | 0 | DNP |
| Invention | Gel/P-1 | 75/25 | 0.396 | 0 | DNP |
| Comparison | Gel/P-1 | 50/50 | 0.132 | 0 | 146 |
| Invention | Gel/P-1 | 50/50 | 0.264 | 0 | 466 |
| Invention | Gel/P-1 | 50/50 | 0.396 | 0 | DNP |
| Comparison | Gel/P-1 | 15/85 | 0.385 | 0 | 197 |
| Comparison | Gel/P-1 | 15/85 | 0.550 | 0 | 295 |
| Invention | Gel/P-1 | 15/85 | 0.715 | 0 | 381 |
| Comparison | Gel/P-1 | 10/90 | 0.132 | 0 | 35 |
| Comparison | Gel/P-1 | 10/90 | 0.385 | 0 | 205 |
| Invention | Gel/P-1 | 10/90 | 0.715 | 0 | 365 |

The data in Table 1 shows that the adhesion of gelatin/amine containing polymer subbing layers unexpectedly depends on a combination of both gelatin/polymer ratio and dry coverage. Based on practical testing of photographic systems, it is desirable to have processed dry adhesion peel force values greater than or equal to 309 N/m. From the results above, this condition is achieved when the combination of subbing coverage (C, in units of g/m$^2$) and weight fraction of gelatin (Z) in the mixture satisfies the equation: $C+1.32\times Z \geqq 0.825$. Particularly useful combinations are with low concentrations of polymer; 20% to 40% by weight.

EXAMPLE 2

Example 1 is repeated except that the support is subjected to oxygen glow discharge treatment and corona discharge treatment in place of the nitrogen glow discharge treatment. Table 2 also repeats the conditions for nitrogen discharge treatment to facilitate ready comparison. In Table 2, the treatment given the support is identified by the following abbreviations:

$O_2$GDT=glow discharge treatment with oxygen gas at 50 mT, 600 W (40 kHz), 50 fpm $N_2$GDT=glow discharge treatment with nitrogen gas at 50 mT, 600 W (40 kHz), 50 fpm.

CDT=corona discharge treatment, 200 W, 20 fpm.

For these examples a single layer gelatin silver halide emulsion, approximately 20 g/m$^2$ is used.

TABLE 2

| Sample | Support Treat-ment | Gelatin/P-1 Wt. Ratio | Dry Coverage (g/m2) | Wet Adhesion (% removed) |
|---|---|---|---|---|
| Comparison | $O_2$GDT | 100/0 | 0.132 | 100 |
| Invention | $O_2$GDT | 80/20 | 0.132 | <1 |
| Invention | $O_2$GDT | 60/40 | 0.132 | 0 |
| Invention | $O_2$GDT | 50/50 | 0.132 | 0 |
| Invention | $O_2$GDT | 68/32 | 0.055 | 0 |
| Invention | $O_2$GDT | 68/32 | 0.132 | 0 |
| Invention | $O_2$GDT | 68/32 | 0.220 | 0 |
| Invention | $O_2$GDT | 68/32 | 0.440 | 0 |
| Invention | $O_2$GDT | 68/32 | 0.880 | 0 |
| Invention | $O_2$GDT | 68/32 | 1.100 | 5 |
| Comparison | $N_2$GDT | 100/0 | 0.132 | 100 |
| Invention | $N_2$GDT | 80/20 | 0.132 | 0 |
| Invention | $N_2$GDT | 60/40 | 0.132 | 0 |
| Invention | $N_2$GDT | 50/50 | 0.132 | 0 |
| Invention | $N_2$GDT | 68/32 | 0.055 | 0 |
| Invention | $N_2$GDT | 68/32 | 0.132 | 0 |
| Invention | $N_2$GDT | 68/32 | 0.220 | 0 |
| Invention | $N_2$GDT | 68/32 | 0.440 | <1 |
| Invention | $N_2$GDT | 68/32 | 0.880 | 0 |
| Invention | $N_2$GDT | 68/32 | 1.100 | 0 |
| Comparison | CDT | 100/0 | 0.132 | 100 |
| Invention | CDT | 60/40 | 0.132 | 20 |
| Comparison | CDT | 15/85 | 0.385 | 80 |

These results show that low levels of an amine containing polymer in a gelatin sub improves the wet adhesion of a photographic emulsion to a treated support.

EXAMPLE 3

Example 1 is repeated using polymers specifically identified in Table 1 of Ponticello U.S. Pat. No. 4,695,532 at polymer to gelatin ratios and dry coverages both inside and outside the present invention. The polymers employed are identified using the same number designation as in the '532 patent and are as follows:

P-3=Poly(ethyl acrylate-co-2-amino ethyl methacrylate hydrochloride-co-2-hydroxyethyl methacrylate) (60/15/25)

P-10=Poly(n-butyl acrylate-co-2-amino ethyl methacrylate hydrochloride-co-2-hydroxyethyl methacrylate) (50/5/45)

P-11=Poly(n-butyl acrylate-co-2-amino ethyl methacrylate hydrochloride-co-2-hydroxyethyl methacrylate) (50/15/35)

P-12=Poly(n-butyl acrylate-co-styrene-co-2-amino ethyl methacrylate hydrochloride) (60/30/10).

The results obtained are reported in Table 3, below.

TABLE 3

| Sample | Subbing | Wt. Ratio (gel/polymer) | Dry Coverage (g/m2) | Dry Adhesion (N/m) |
|---|---|---|---|---|
| Comparison | Gel/P-3 | 15/85 | 0.209 | 365 |
| Invention | Gel/P-3 | 15/85 | 0.770 | Note 1. |
| Invention | Gel/P-3 | 75/25 | 0.209 | DNP |
| Invention | Gel/P-10 | 75/25 | 0.132 | DNP |
| Comparison | Gel/P-11 | 15/85 | 0.209 | 163 |
| Invention | Gel/P-11 | 15/85 | 0.770 | 566 |
| Invention | Gel/P-11 | 75/25 | 0.209 | DNP |
| Comparison | Gel/P-12 | 15/85 | 0.209 | 90 |
| Invention | Gel/P-12 | 15/85 | 0.770 | 490 |
| Invention | Gel/P-12 | 75/25 | 0.209 | DNP |

1. There was failure within the emulsion layer, but no failure of the subbing layer.

The results reported in Table 3 show that adhesion depends on a combination of gelatin to polymer ratio and dry coverage. When the subbing material is coated within the ranges described in the '532 patent, dry adhesion is not nearly as good as that which is obtained when the subbing layer satisfies the criteria of the present invention.

The invention has been described herein by reference to preferred embodiments, but it will be understood changes can be made to the embodiments of the invention specifically described herein within the spirit and scope of the invention.

What is claimed is:

1. A polyester photographic film support having a surface coated with a subbing layer which comprises a mixture of gelatin and a polymer where the gelatin to polymer ratio is less than 97:3 and equal to or greater than 55:35 and such that the combination of dry coverage and weight fraction of gelatin in the mixture satisfies the equation: $C+1.32\times Z\geqq 0.825$, where C is dry coverage in g/m$^2$ and Z is the weight fraction of gelatin, and the polymer comprises:

a) from 1 to 60 weight percent of recurring units derived from a vinyl monomer having a primary amine addition salt component or aminostyrene addition salt component;

b) from 0 to 50 weight percent of recurring units derived from a hydrophilic vinyl monomer; and c) from 20 to 98 weight percent of recurring units derived from a hydrophobic nonionic vinyl monomer.

2. The polyester photographic film support of claim 1 wherein Z is 0.55 to 0.90 and C is 0.11 to 0.55.

3. The polyester photographic film support of claim 1 wherein the combination of dry coverage and weight fraction of gelatin in the mixture satisfies the equation: $C+1.44\times Z\geqq 0.9$.

4. The polyester photographic film support of claim 3 wherein the gelatin/polymer ratio is in the range of 80:20 to 65:35.

5. The polyester photographic film support of claim 1 wherein the vinyl monomer having the primary amine addition salt component has the structure:

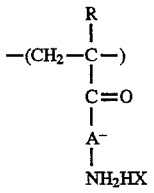

(I)

and the polymerized vinyl monomer having the aminostyrene addition salt component has the structure:

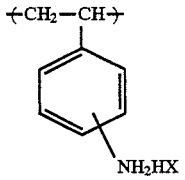

(II)

wherein

R is hydrogen or methyl;

A is either —$OR^1$— or

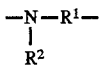

$R^1$ is a straight or branched chain alkylene group of 1 to about 6 carbon atoms;

$R^2$ is hydrogen or a straight or branched chain alkyl or cycloalkyl group of 1 to 10 carbon atoms: and X is an acid anion.

6. The polyester photographic film support of claim 1 wherein the vinyl monomer having the primary amine addition salt component has the structure:

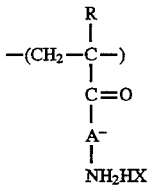

(I)

A is either —$OR^1$— or

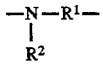

and

X is an acid anion.

7. The polyester photographic film support of claim 1 wherein the polymer comprises:

(a) from 1 to 60 weight percent of recurring units derived from an amino ethyl methacrylate hydrochloride or an amino propylmethacrylamide hydrochloride;

(b) from 0 to 50 weight percent of hydroxyethyl methacrylate; and (c) 20 to 98 weight percent of butyl acrylate, butyl methacrylate, methyl acrylate, ethyl acrylate, or styrene.

8. The polyester photographic film support of claim 1 wherein the polymer is selected from the group consisting of poly(n-butyl acrylate-co-2-aminoethyl methacrylate hydrochloride-co-2-hydroxyethyl methacrylate);

poly(methyl acrylate-co-2-aminoethyl methacrylate hydrochloride-co-2-hydroxyethyl methacrylate);

poly(ethyl acrylate-co-2-aminoethyl methacrylate hydrochloride-co-2-hydroxyethyl methacrylate);

poly[n-butyl methacrylate-co-N-(3-aminopropyl)-methacrylamide hydrochloride-co-2-hydroxyethyl methacrylate];

poly[n-butyl acrylate-co-N-(3-aminopropyl)-methacrylamide hydrochloride-co-2-hydroxyethyl methacrylate]; and poly(n-butyl acrylate-co-styrene-co-2-aminoethyl methacrylate hydrochloride).

9. The polyester photographic film support of claim 1 wherein the dispersed polymer is selected from the group consisting of:

poly(n-butyl acrylate-co-2-aminoethyl methacrylate hydrochloride-co-2-hydroxyethyl methacrylate) (60/15/25);

poly(methyl acrylate-co-2-aminoethyl methacrylate hydrochloride-co-2-hydroxyethyl methacrylate) (50/15/35);

poly(ethyl acrylate-co-2-aminoethyl methacrylate hydrochloride-co-2-hydroxyethyl methacrylate) (60/15/25);

poly(ethyl acrylate-co-2-aminoethyl methacrylate hydrochloride-co-2-hydroxyethyl methacrylate) (50/15/35);

poly(n-butyl acrylate-co-2-aminoethyl methacrylate hydrochloride-co-2-hydroxyethyl methacrylate) (50/30/20);

poly[n-butyl methacrylate-co-N-(3-aminopropyl) methacrylamide hydrochloride-co-2-hydroxyethyl methacrylate] (50/30/20);

poly[n-butyl acrylate-co-N-(3-aminopropyl) methacrylamide hydrochloride-co-2-hydroxyethyl methacrylate] (50/15/35);

poly(n-butyl acrylate-co-2-aminoethyl methacrylate hydrochloride-co-2-hydroxyethyl methacrylate) (20/60/20);

poly(n-butyl acrylate-co-2-aminoethyl methacrylate hydrochloride-co-2-hydroxyethyl methacrylate) (50/10/40);

poly(n-butyl acrylate-co-2-aminoethyl methacrylate hydrochloride-co-2-hydroxyethyl methacrylate) (50/5/45);

poly(n-butyl acrylate-co-2-aminoethyl methacrylate hydrochloride-co-2-hydroxyethyl methacrylate) (50/15/35); and poly(butyl acrylate-co-styrene-co-2-aminoethyl methacrylate hydrochloride) (60/30/10).

10. The polyester photographic film support of claim 4 wherein the polymer is poly(n-butyl acrylate-co-2-aminoethyl methacrylate hydrochloride-co-2-hydroxyethyl methacrylate).

11. The polyester photographic film support of claim 1 wherein a surface is initially treated by corona discharge, glow discharge, flame, or ultraviolet light.

12. The polyester photographic film support of claim 8 wherein the treatment is glow discharge.

13. The polyester photographic film support of claim 1 wherein the polyester is polyethylene terephthalate.

14. The polyester photographic film support of claim 1 wherein the polyester is polyethylene naphthalate.

15. The polyester photographic film support of claim 1 wherein the uppermost 5 nm of the support includes nitrogen from about 7 atomic percent to about 15 atomic percent wherein the nitrogen is in the form of imines, secondary amines, and primary amines in a ratio of about 1:1:2.

16. The polyester photographic film support of claim 1 wherein the surface further includes oxygen in the form of carboxyl and carbonyl groups.

17. The polyester photographic film support of claim 1 wherein the uppermost 5 nm of the support includes oxygen in the form of hydroxyl, ether, epoxy, carbonyl, and carboxyl groups, the oxygen is from about 4 atomic percent to about 10 atomic percent above the original surface content.

18. The polyester photographic film support of claim 15 formed by:

passing the polyester support in front of a powered electrode wherein the energy dose applied on the surface is between 0.06 and 4.5 $J/cm^2$ and the pressure at the electrode is from 35 mTorr to 100 mTorr.

19. The polyester photographic film support of claim 18 wherein an atmosphere at the electrode is nitrogen, ammonia, inert gases, or mixtures thereof.

20. The polyester photographic film support of claim 17 formed by:

passing the polyester support in front of a powered electrode wherein the energy dose applied on the surface is between 0.5 and 3.0 $J/cm^2$ and the pressure at the electrode is from 35 mTorr to 70 mTorr.

21. The polyester photographic film support of claim 20 wherein an atmosphere at the electrode is oxygen, water, inert gases, or mixtures thereof.

22. A photographic element having at least one light-sensitive layer on the polyester photographic film support of claim 1.

23. A photographic element having at least one light-sensitive layer on the photographic film support of claim 12.

* * * * *